US008023866B2

(12) United States Patent
Lean et al.

(10) Patent No.: US 8,023,866 B2
(45) Date of Patent: Sep. 20, 2011

(54) POWDERED TONER DIRECT MARKING APPARATUS

(75) Inventors: Meng H Lean, Santa Clara, CA (US); Shu Chang, Pittsford, NY (US); Baomin Xu, San Jose, CA (US); Karl A Littau, Palo Alto, CA (US); David G Duff, Portola Valley, CA (US)

(73) Assignee: Xerox Corporation, Norwalk, CT (US)

( * ) Notice: Subject to any disclaimer, the term of this patent is extended or adjusted under 35 U.S.C. 154(b) by 564 days.

(21) Appl. No.: 12/184,116

(22) Filed: Jul. 31, 2008

(65) Prior Publication Data

US 2010/0028054 A1 Feb. 4, 2010

(51) Int. Cl.
*G03G 15/08* (2006.01)

(52) U.S. Cl. ..... 399/266; 399/290

(58) Field of Classification Search ..... 399/266, 399/411, 289–291; 347/110
See application file for complete search history.

(56) References Cited

U.S. PATENT DOCUMENTS

| | | | | |
|---|---|---|---|---|
| 5,742,884 | A * | 4/1998 | Germain et al. | 399/266 |
| 6,219,515 | B1 * | 4/2001 | Lestrange | 399/289 |
| 6,246,855 | B1 | 6/2001 | Gartstein et al. | |
| 7,217,901 | B2 | 5/2007 | Lean et al. | |
| 7,293,862 | B2 | 11/2007 | Lean et al. | |
| 7,304,258 | B2 | 12/2007 | Lean et al. | |
| 7,894,754 | B2 * | 2/2011 | Hazeyama | 399/266 |
| 2007/0086811 | A1 * | 4/2007 | Tsukamoto et al. | 399/265 |
| 2009/0190964 | A1 * | 7/2009 | Lin et al. | 399/266 |
| 2010/0028055 | A1 * | 2/2010 | Lean et al. | 399/266 |

* cited by examiner

*Primary Examiner* — David Gray
*Assistant Examiner* — Rodney Bonnette
(74) *Attorney, Agent, or Firm* — Fay Sharpe LLP

(57) ABSTRACT

A marking apparatus including a traveling wave grid toner transport circuit structure for transporting powdered toner along a transport surface, and electromechanical elements for selectively enabling toner patches to be projected to an output medium by a projecting electric field.

17 Claims, 4 Drawing Sheets

POWDERED TONER DIRECT MARKING APPARATUS

CROSS REFERENCE TO RELATED APPLICATIONS

Cross reference is made to the following concurrently filed application, the disclosure of which is totally incorporated by reference herein: U.S. application Ser. No. 12/184,135, filed Jul. 31, 2008, entitled "Powdered Toner Direct Marking Apparatus."

INCORPORATION BY REFERENCE

The following U.S. Patents are specifically incorporated by reference herein: U.S. Pat. No. 7,217,901; U.S. Pat. No. 7,293,862; and U.S. Pat. No. 7,304,258.

BACKGROUND

The subject disclosure is generally directed to a direct marking apparatus, such as a printer or other hardcopy apparatus, that uses powdered toner as a marking component.

Conventional marking apparatus that use powdered toner as a marking component commonly employ electrostatographic techniques wherein an electrostatic latent image is lightwise formed on a photoconductive imaging surface and then developed by deposition of suitably electrically charged powdered toner on the photoconductive imaging surface. The developed image is transferred to an output medium (e.g., paper or other substrate), for example via a suitable transfer member such as a transfer belt or roll. After the transfer of the developed image to the output medium, the developed image is fixed, for example by application of pressure and/or heat.

Known powdered toner marking apparatus can be complex.

DETAILED DESCRIPTION

Figure 1:
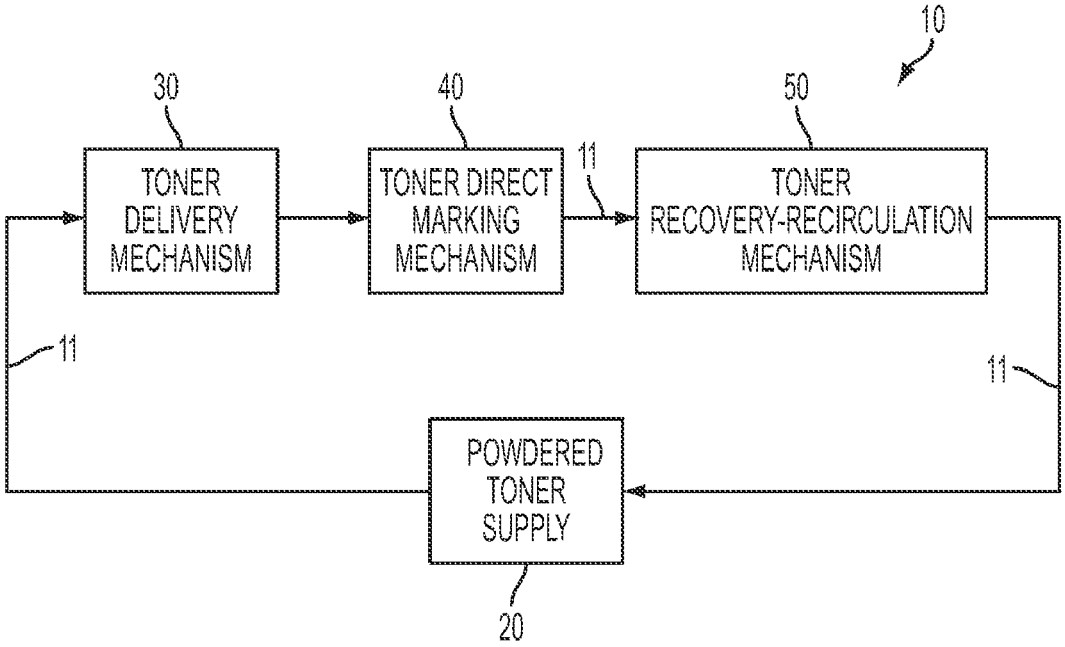
FIG. 1 is a schematic block diagram of a powdered toner direct marking system.

FIG. 1 is a schematic block diagram of a direct marking system 10 that includes in series a powdered toner feed or delivery mechanism 30, a powdered toner marking mechanism 40, and a powdered toner recovery or recirculation mechanism 50. The powdered toner feed mechanism receives or obtains suitably electrically charged powdered toner 11 from a powdered toner supply 20 and provides powdered toner to the feed mechanism 30 that in turn provides powdered toner to the marking mechanism 40. The toner recovery mechanism 50 can return unused powdered toner to the toner supply 20, for example, for reuse by recirculation.

As more particularly described herein, the feed mechanism 30, the marking mechanism 40 and the recovery mechanism can comprise portions of a traveling wave grid that cooperate to transport a powdered toner cloud through the marking mechanism, and are configured to control the height or shape of the powdered toner cloud. The marking mechanism 40 is more particularly configured to selectively release and project patches of powdered toner (of controlled thickness, for example) to an output medium 81, wherein the patches of powdered toner generally comprise relatively small amounts of powdered toner. The propelled toner patches can also be called pixels for convenience. In that regard, the feed mechanism 30, the marking mechanism 40 and the recovery mechanism 50 can be more particularly configured to prevent the transported powdered toner from coming into contact with an output medium except as commanded by the print mechanism 40.

Figure 2:
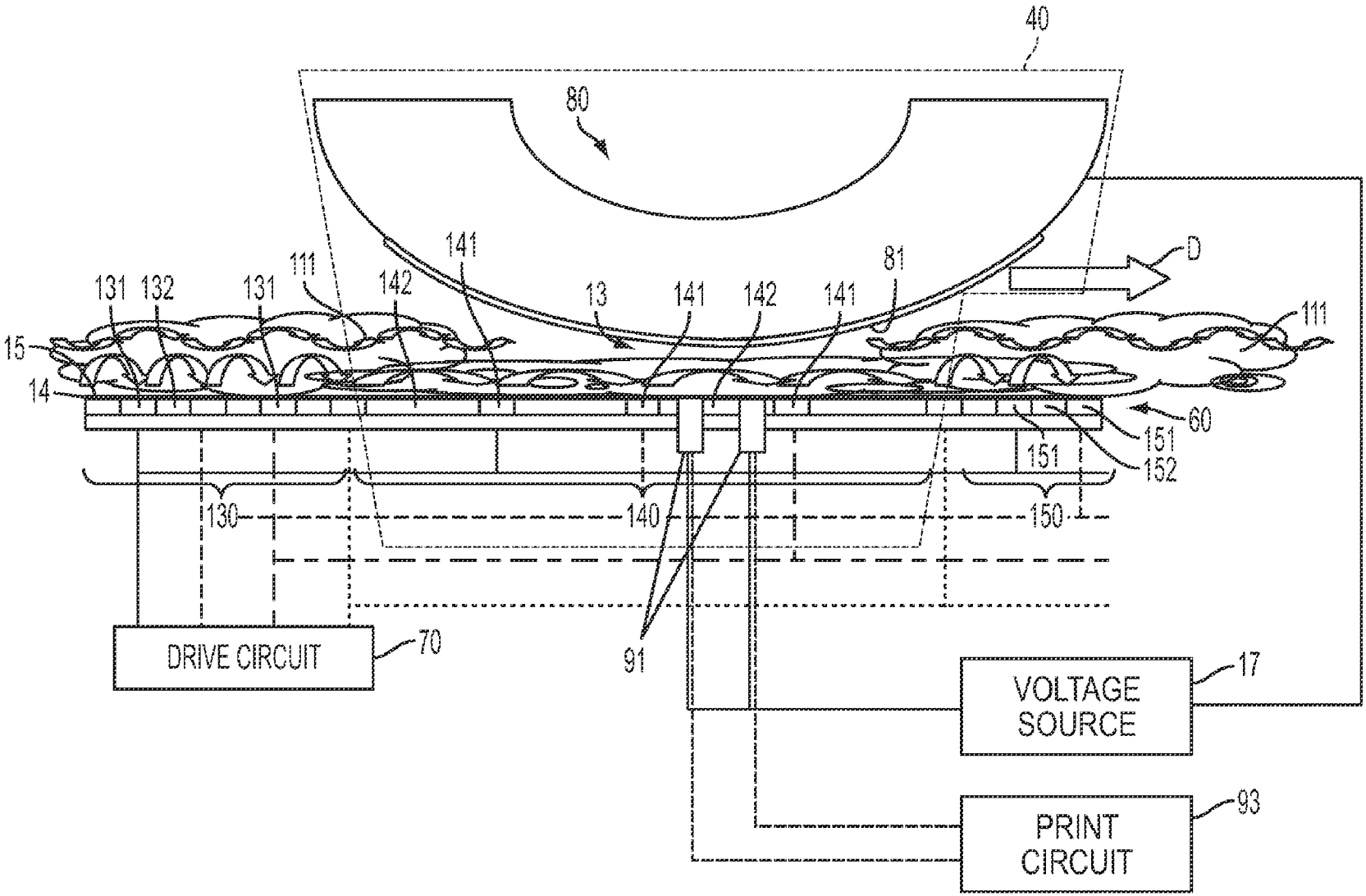
FIG. 2 is a schematic block diagram of a powdered toner direct marking system that includes a traveling wave grid circuit structure.

FIG. 2 is a block diagram of a direct marking system wherein the powdered toner feed mechanism 30, the powdered toner marking mechanism 40 and the powdered toner recovery mechanism 50 comprise serially adjoining regions or portions 130, 140, 150 of a traveling wave grid circuit structure 60 that is suitably driven by a drive circuit 70.

The traveling wave grid feed portion 130 includes electrodes or conductive traces 131 and spacers 132, the traveling wave grid marking portion 140 includes electrodes or conductive traces 141 and spacers 142, and the traveling wave grid extraction portion 150 includes electrodes or conductive traces 151 and spacers 152. The traveling wave grid circuit structure further includes a thin electrically insulating outer layer 14 that overlies the electrodes 131, 141, 151 and the spacers 132, 142, 152, and provides an electrically insulated transport surface 15.

The marking mechanism 40 further includes a receiver structure 80 that is adjacent the traveling wave grid marking portion 140 and separated therefrom by a gap 13. The receiver structure 80 suitably supports an output medium 81 such a receiver substrate generally oppositely the traveling wave grid portion 140. The output medium 81 can comprise a hardcopy substrate such as paper or film, or a transfer coating, for example.

The traveling wave circuit structure 60 is configured to transport a powdered toner cloud 111 along the transport surface 15 from the feed region 130 to the marking region 140 to the recovery region 150, generally along a transport direction D. The traveling wave grid circuit structure 60 is further configured to control the height of the powdered toner cloud such that it does not come into contact with the output medium 81 and produce unwanted development or marking. For example, the traveling wave grid marking portion 140 is configured to produce an electric field that is flatter than the electric fields produced by the grid regions 130, 150, so as to allow the toner cloud to "duck" as it passes through the narrow part of the gap 13 without contacting the output medium 81 (except as commanded by other components of the marking mechanism described further herein). This can be accomplished, for example, by appropriately selecting the pitch or spacing of the traces 141 of the traveling wave grid marking region 140 and/or selecting the material of the spacers 142 of the traveling wave grid marking region 140. For example, the pitch or spacing of the traces 141 of the traveling wave grid marking region 140 can be greater than the spacing of the traces 131, 151 of the traveling wave grid feed and extraction regions 130, 150. As a further example, the spacers 142 of the traveling wave grid marking region 140 can comprise a finite conductivity (i.e., electrically resistive) material such as carbon impregnated rubber while the spacers 132, 152 of the traveling wave grid feed and extraction regions 130, 150 can comprise dielectric material. The finitely conductive spacers 142 (which can be formed of resistive film, for example) function to conduct a surface current which allows for a linear lateral drop of the surface voltage. The electric field is flattened to lie on the surface of the finitely conductive spacers. Toner follows the field lines and therefore transit the gap 13 in sliding contact with the transport surface 15 of the thin outer layer 14. The electric field generated by the traveling wave grid marking region 140 supports a few particle layers of toner that adhere to the transport surface by van der Waals adhesion. In other words, toner is transported over the traveling wave grid marking region 140 as a sheet or carpet of toner of controlled thickness.

By way of illustrative example, the traveling wave grid 60 can comprise conductive traces and intervening spacers of suitable composition deposited or printed on a non-conductive substrate such as a polyamide layer. The conductive traces and the spacers can be covered with a Tedlar or Kapton film that forms the electrically insulating outer layer 14.

Figure 3:
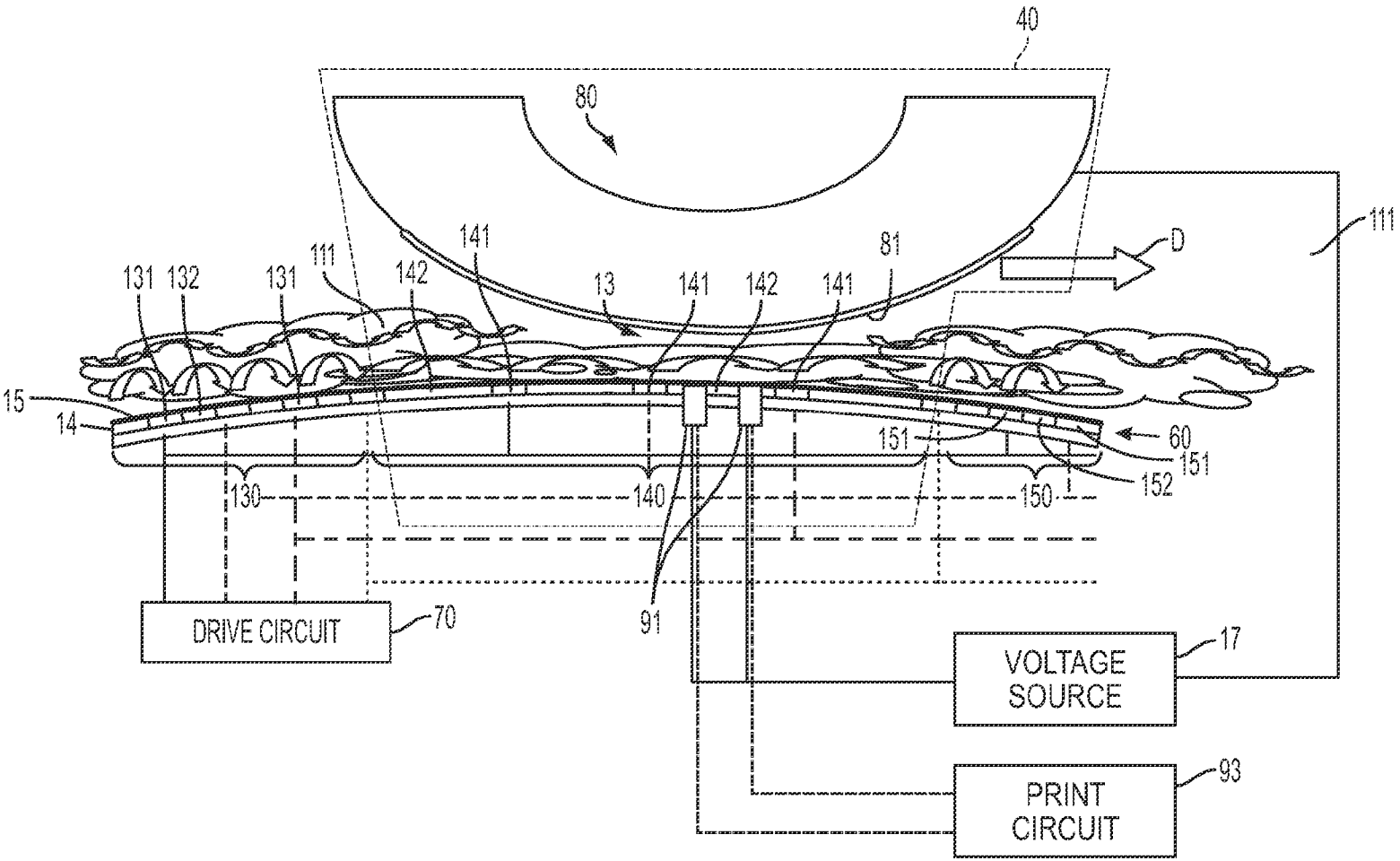
FIG. 3 is a schematic block diagram of an arcuately shaped traveling wave grid circuit structure that can be employed in the direct marking system of FIG. 2.

By way of further illustrative examples, the traveling wave grid can be generally planar or arcuate (as schematically depicted in FIG. 3).

The marking mechanism 40 further includes electromechanical and electric field generating components for releasing patches of powdered toner and projecting released toner patches onto the output medium 81. For example, the marking mechanism includes an array 90 of addressable electromechanical transducers or print elements 91 in or adjacent the traveling wave grid marking region 140. The electromechanical transducers 91 are selectively addressably driven by a print drive circuit 93 to release toner patches from the portion of the toner cloud adjacent the electromechanical transducers 91. The released toner patches are projected or accelerated to the output medium by a projecting DC electric field generated by a circuit that includes a DC voltage source 17, the receiver structure 80, and the electromechanical transducers 91. For example, the voltage source 17 biases the portion of the receiver structure 80 adjacent the back of the output medium 81 with respect to the transducers 91 using a voltage of opposite polarity to attract the released toner patches. The projecting electric field is constantly on and by itself is below the detachment threshold or insufficient to electrostatically detach toner from the relatively thin toner cloud traveling over the traveling wave grid marking region 140. In this manner, the toner sheet is biased at a DC voltage level that is below the detachment voltage. In a specific example wherein the DC voltage level is just below the detachment threshold, toner release can be achieved by a relatively small incremental voltage to detach the toner which when freed is projected by the constant DC bias field across the gap 13 to the output medium 81. Thus, in such example relatively small switching voltages can be employed which can allow for high printing frequencies.

Figure 4:
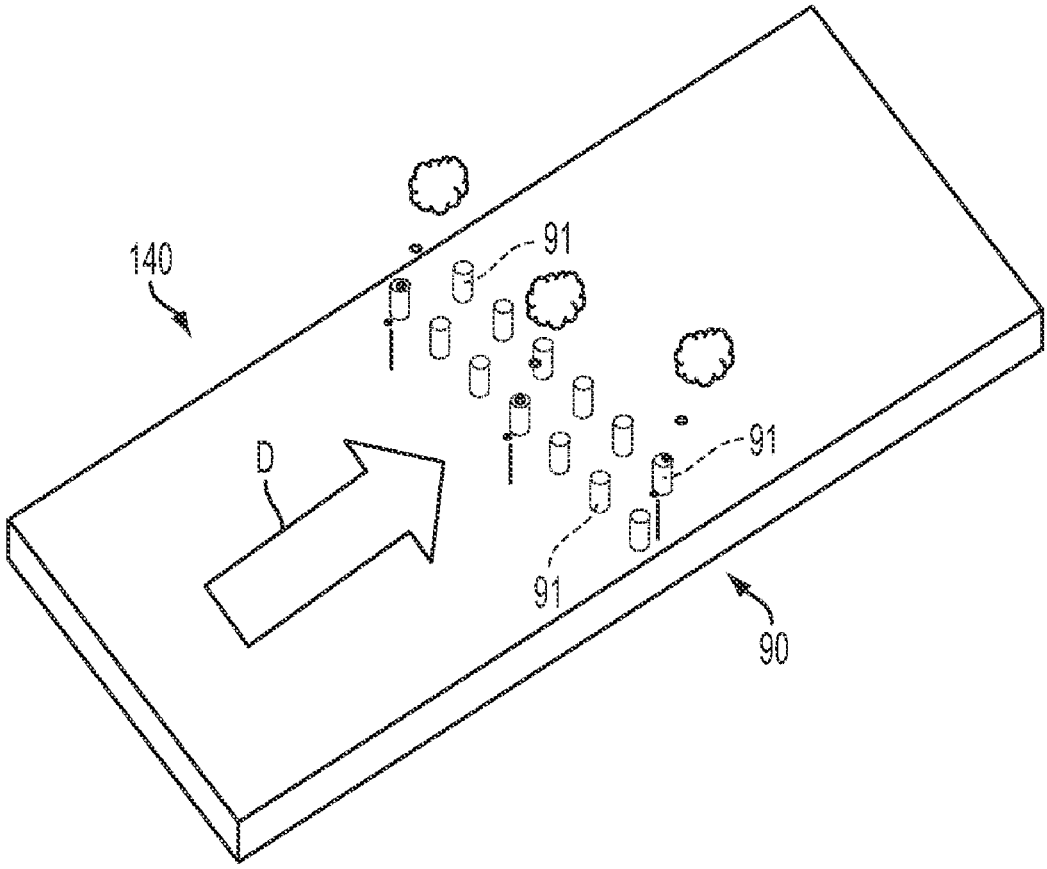
FIG. 4 is a schematic perspective view of a portion of the marking mechanism of the direct marking system of FIG. 2 showing electromechanical marking elements.
Figure 5:
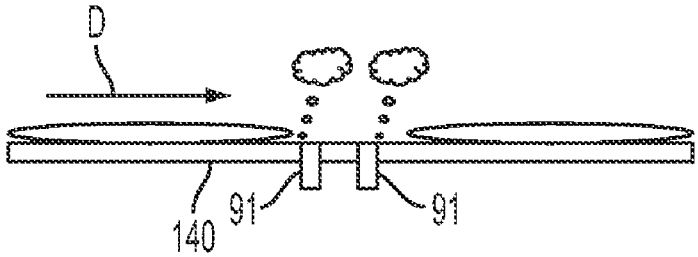
FIG. 5 is a schematic elevation view of the portion of the marking mechanism depicted in FIG. 4.

The electromechanical transducers 91 can comprise for example piezoelectric elements, and can be arranged in one or more rows oriented generally transverse to the toner transport direction D, as generally depicted in FIGS. 4 and 5. In conjunction with such an array of electromechanical transducers, the receiver output medium 81 can be scanned or translated parallel to the toner transport direction D relative to the transport surface of the traveling wave grid circuit structure 15, for example continuously or incrementally, such that a two dimensional pixel array on the output medium can be selectively marked with powdered toner patches. Employing a plurality of staggered rows of electromechanical transducers can provide for increased pixel resolution.

By way of illustrative example, the electromechanical transducers can be driven at relatively high frequency and relatively low transducer displacement or amplitude (e.g., a maximum of about 10 nanometers) that in the presence of the projecting electric field causes patches of toner to overcome the van der Waals adhesion and be released from the toner sheet. By way of specific example, the electromechanical transducers can be operated at a frequency in the range of about 20 KHz to about 50 KHz. As another example, the electromechanical transducers can be operated at a frequency in the range of about 40 KHz to about 70 KHz. More generally, the electromechanical transducers can be operated at frequencies in the range of about 100 Hz to about 100 KHz.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A marking apparatus comprising:

a traveling wave grid toner transport circuit structure having in series a feed portion, a marking portion, and an recovery portion, wherein the portions have a generally continuous transport surface;

the transport circuit structure being configured to transport a powdered toner cloud along the transport surface generally along a transport direction;

a receiver having a receiver surface adjacent and separated by a gap from the transport surface of the marking portion of the transport circuit structure;

a circuit for generating a projecting electric field in the gap between the receiver surface and the transport surface;

a plurality of electromechanical transducers located in the marking portion of the transport circuit structure for selectively releasing patches of toner from the transport surface such that such released toner patches are projected across the gap by the projecting electric field;

the traveling wave grid toner transport structure being configured to prevent toner from contacting the receiver surface except as to toner patches released by the electromechanical elements; and the projecting electric field being insufficient to cause transfer of toner to the receiver surface except when released by the electromechanical transducers.

2. The marking apparatus of claim 1 wherein the marking portion of the traveling wave grid toner transport structure includes a plurality of spaced apart electrodes, and wherein the spacing between electrodes in the marking portion is configured to produce an electric field that is flatter than the electric fields produced by the feed and recovery portions.

3. The marking apparatus of claim 1 wherein the marking portion of the traveling wave grid toner transport circuit structure includes a plurality of electrodes spaced apart by finitely conductive spacers.

4. The marking apparatus of claim 1 wherein the electromechanical transducers are addressable.

5. The marking apparatus of claim 1 wherein the electromechanical transducers are arranged in staggered rows.

6. The marking apparatus of claim 1 wherein the electromechanical transducers comprise piezoelectric transducers.

7. The marking apparatus of claim 1 wherein the electromechanical transducers comprise piezoelectric transducers that are operated for amplitude displacement of not more than about 10 nanometers.

8. A marking apparatus comprising:

a traveling wave grid toner transport circuit structure having a transport surface;

the transport circuit structure being configured to transport a cloud of powdered toner along the transport surface generally along a transport direction;

a receiver having a receiver surface adjacent and separated by a gap from the transport surface;

a circuit for generating a projecting electric field in the gap between the receiver surface and the transport surface;

a plurality of piezoelectric elements for selective enabling toner patches to be released from the toner cloud and projected across the gap by the projecting electric field;

the traveling wave grid toner transport structure being configured to prevent toner from contacting the receiver surface except as selectively released by the piezoelectric elements.

9. The marking apparatus of claim 8 wherein the traveling wave grid toner transport structure includes a plurality of spaced apart electrodes, and wherein the spacing between electrodes in a marking portion of the traveling wave grid toner transport structure is configured to prevent toner from contacting the receive surface except as selectively released by the piezoelectric elements.

10. The marking apparatus of claim 8 wherein the traveling wave grid toner transport circuit structure includes a plurality of electrodes spaced apart by finitely conductive spacers.

11. The marking apparatus of claim 8 wherein the electromechanical transducers are addressable.

12. The marking apparatus of claim 8 wherein the electromechanical transducers are arranged in staggered rows.

13. The marking apparatus of claim 8 wherein the electromechanical transducers comprise piezoelectric transducers.

14. The marking apparatus of claim 8 wherein the electromechanical transducers comprise piezoelectric transducers that are operated for amplitude displacement of not more than about 10 nanometers.

15. A method of printing comprising:

transporting a powdered toner cloud through an electric field; and selectively actuating electromechanical transducers to enable small amounts of toner to be projected by the electric field to an output medium.

16. The method of claim 15 wherein transporting powdered toner comprises using a traveling wave grid circuit to transport powdered toner through an electric field.

17. The method of claim 15 wherein selectively actuating electromechanical transducers comprises selectively actuating piezoelectric transducers to enable small amounts of toner to be propelled by the electric field to an output medium.

* * * * *

UNITED STATES PATENT AND TRADEMARK OFFICE

CERTIFICATE OF CORRECTION

PATENT NO. : 8,023,866 B2
APPLICATION NO. : 12/184116
DATED : September 20, 2011
INVENTOR(S) : Meng H. Lean et al.

It is certified that error appears in the above-identified patent and that said Letters Patent is hereby corrected as shown below:

Title Pg, Item (73) Assignee: should read,

-- (73) Assignee: Xerox Corporation, Norwalk, CT (US)
Palo Alto Research Center Incorporated, Palo Alto, CA (US) --

Signed and Sealed this
Twenty-seventh Day of December, 2011

David J. Kappos

David J. Kappos
*Director of the United States Patent and Trademark Office*